United States Patent [19]

Millis et al.

[11] Patent Number: 4,505,643

[45] Date of Patent: Mar. 19, 1985

[54] LIQUID PUMP CONTROL

[75] Inventors: Donald E. Millis; Rodger J. Grys, both of Norwalk, Ohio

[73] Assignee: North Coast Systems, Inc., Norwald, Ohio

[21] Appl. No.: 476,813

[22] Filed: Mar. 18, 1983

[51] Int. Cl.[3] ..... F04B 49/00

[52] U.S. Cl. ..... 417/12; 210/138; 210/169; 210/416.2; 417/33; 417/44

[58] Field of Search ..... 417/12, 33, 44; 210/138, 169, 416.2

[56] References Cited

U.S. PATENT DOCUMENTS

| | | | |
|---|---|---|---|
| 2,981,195 | 4/1961 | Payne et al. | 417/12 |
| 3,867,290 | 2/1975 | Mackey | 210/138 |
| 3,963,375 | 6/1976 | Curtis | 417/12 |
| 4,180,374 | 12/1979 | Bristow | 417/12 |
| 4,224,154 | 9/1980 | Steininger | 210/169 X |
| 4,239,457 | 12/1980 | Langford | 417/33 |
| 4,329,120 | 5/1982 | Walters | 417/12 |
| 4,330,238 | 5/1982 | Hoffman | 417/45 X |
| 4,421,643 | 12/1983 | Frederick | 417/12 |

*Primary Examiner*—Edward K. Look
*Attorney, Agent, or Firm*—Fay & Sharpe

[57] ABSTRACT

A circulating pump (B) pumps water between a swimming pool or other reservoir (A) and a filter or other circulated fluid receiving apparatus (C). A control circuit (D) intermittently operates the circulating pump. The operating circuit includes a first timer (32) and a cycle switch (34) which is cyclically closed to produce a pump signal for a first duration with a first periodicity. The pump signal starts a second timer (54) of a time controlled switch (52). The second timer holds the time controlled switch conductive for a preselected time period. The pump signal is conducted through a bypass switch (64), and the time actuated switch. When the pressure monitored by a pressure sensor (20) exceeds a preselected pressure, a low pressure switch (62) closes conducting the pump signal around the bypass and time controlled switches. A high pressure shutoff switch (66) conducts the pump signal to a power relay coil (72) unless a preselected high pressure is monitored. The power relay coil controls relay contacts (74) through which electric power is supplied to a pump motor (40).

5 Claims, 2 Drawing Figures

FIG. 1
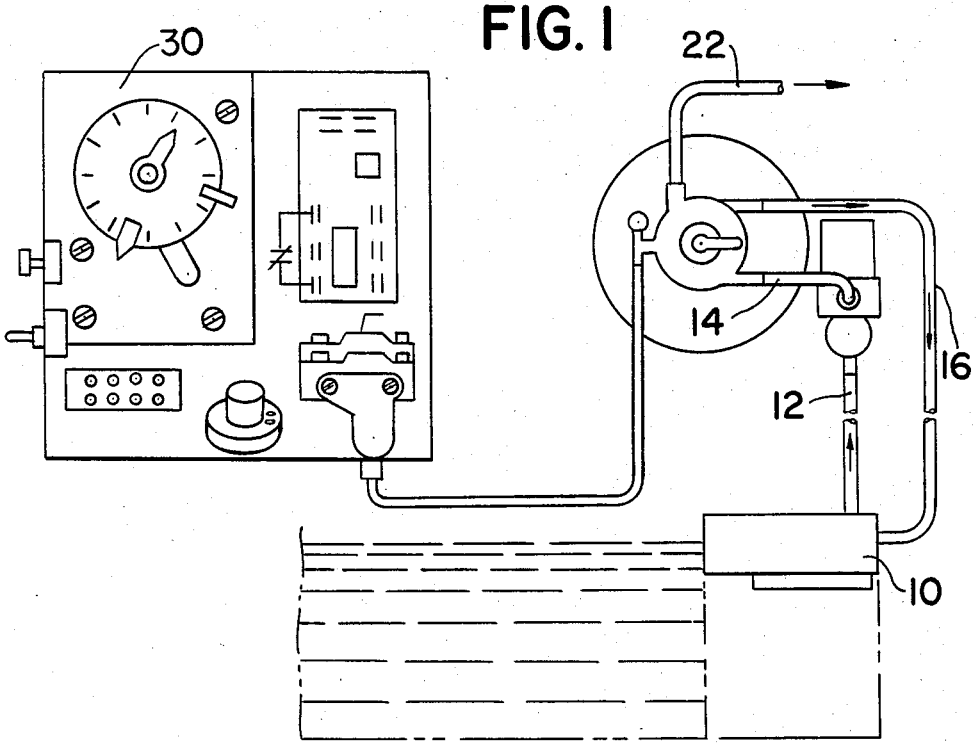
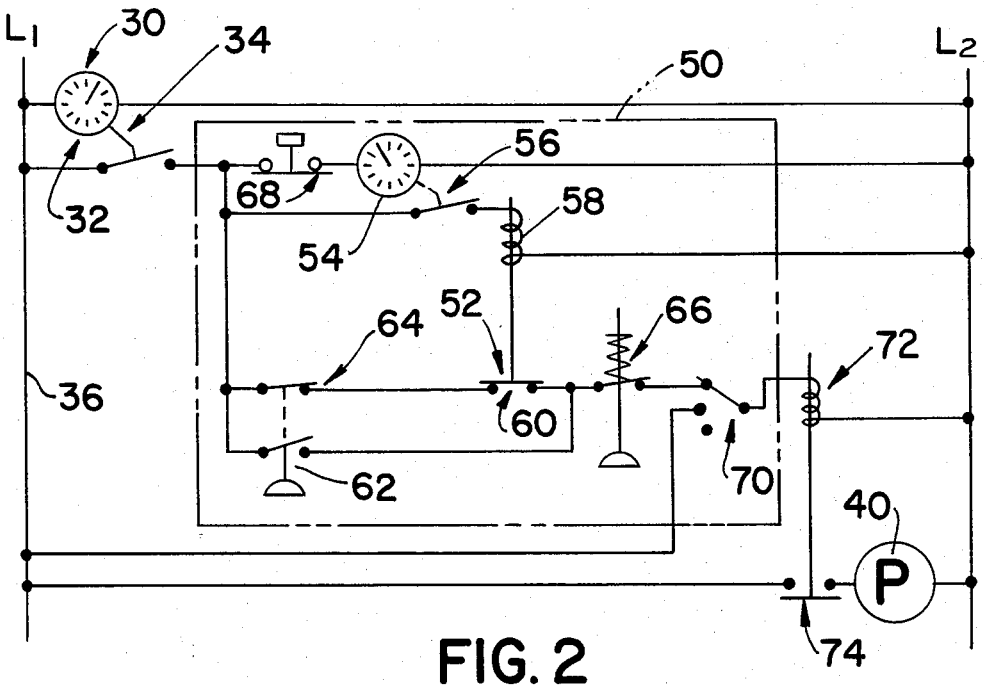
FIG. 2

LIQUID PUMP CONTROL

BACKGROUND OF THE INVENTION

The present invention relates to controllers for controlling the operation of electrical apparatus, such as a pump. The invention finds particular application in the cyclic control of circulating pumps such as a swimming pool filter pump for circulating water from a swimming pool through a filter system. It is to be appreciated, however, that the present invention is also applicable to controlling circulating pumps of other types including water heating and cooling systems, industrial fluid circulating or mixing systems, and the like.

Heretofore, various control systems have been developed for periodically actuating electrical apparatus such as a pump. Some prior art control systems further monitored the electrical apparatus for malfunctions. One such monitored malfunction is an excessive pressure which causes the pump to cut out or shut off.

In many fluid pumping systems, low pressure can be just as deleterious, or more so, than high pressure. For example, a subminimum fluid pressure may be indicative of a loss or leak of the pumped fluid, or the like. Operating the pump at a subminimal pressure may cause the pump motor to overheat or burn out. However, in a periodically operated pump, the fluid pressure commonly drops below a minimal operating pressure between pump actuations. Even upon first actuating the pump, some lead time is commonly required to prime the pump and build the fluid pressure up to normal. Accordingly, if the periodically actuated pump had a low pressure cutoff switch, start up of the pump would be impossible.

The present invention contemplates a new and improved pump control which is responsive to abnormally high as well as abnormally low pumping pressures, yet provides for automatic start up and priming of the pump.

SUMMARY OF THE INVENTION

In accordance with a first aspect of the invention, a control circuit is provided for controlling cyclic operation of a circulating pump. The control circuit includes an intermittent actuating means for intermittently producing a pump signal. The intermittent actuating means is operatively connected with the circulating pump for causing the pump to pump a circulated fluid therethrough during receipt of the pump signal. A low pressure shutdown means terminates operation of the circulating pump, unless a monitored circulated fluid pressure attains a preselected pressure level within a preselected time period. In this manner, after commencement of the pump signal, the circulating pump functions to pump the circulated fluid for the preselected time period. After the preselected time period, the pump continues to operate if the preselected pressure is attained and terminates operation until the next cycle if the preselected pressure is not attained.

In accordance with another aspect of the invention, a fluid circulation system is provided which includes the foregoing control circuit, a fluid reservoir, a circulating pump, and a fluid receiving apparatus.

In accordance with a more limited aspect of the invention, the fluid reservoir comprises a swimming pool and the fluid receiving apparatus comprises a water filter.

One advantage of the present invention is the provision of protection for the circulating pump so that it will not operate for an extended period at an injuriously low pressure.

Another advantage of the invention resides in protection for a fluid circulation system against low pressure related failures.

Yet another advantage of the invention is that it protects swimming pool filtration systems which are operated automatically and without human supervision or human monitoring from destructive malfunctions.

Still further advantages of the invention will become apparent to those skilled in the art upon a reading and understanding of the following detailed description.

BRIEF DESCRIPTION OF THE DRAWINGS

The invention may take form in various parts and arrangements of parts, a preferred embodiment of which is shown in the accompanying drawings which form a part hereof and wherein:

FIG. 1 is a diagrammatic illustration of a water circulating system in accordance with the invention; and, FIG. 2 is circuit diagram for a control circuit formed in accordance with the invention for controlling the water circulation system of FIG. 1.

DETAILED DESCRIPTION OF THE PREFERRED EMBODIMENT

Referring now to the drawings wherein the showings are for purposes of illustrating a preferred embodiment of the invention only and not for limiting same, FIG. 1 shows a reservoir A which holds a supply of the fluid to be circulated. In the preferred embodiment, this reservoir comprises a swimming pool, although it will be appreciated that the invention is applicable to many other types and/or styles of fluid reservoirs. A circulating pump B pumps fluid from the reservoir to a circulating fluid receiving apparatus C. In the preferred embodiment, the circulating fluid receiving apparatus comprises a filter for filtering the swimming pool water. The pressure of the pump is sufficient to pump the fluid from the swimming pool to the filter and back to the pool. A control circuit D intermittently operates the circulating pump B such that the fluid is circulated from the reservoir A to the circulating fluid receiving apparatus C.

The swimming pool A includes a skimmer 10 disposed generally at the pool water level. The circulating pump B draws swimming pool water through a line 12 and urges the water through a line 14 to an inlet of the water filter C. A return line 16 returns filtered water from the filter to the swimming pool. A pressure monitor 20 monitors the pressure of the fluid adjacent the filter inlet. An overflow line 22 provides an overflow for excess water such as may be accumulated during a rain storm.

With particular reference to FIG. 2, as well as continued reference to FIG. 1, the control circuit D includes an intermittent actuating means 30 for intermittently producing a pump signal. More specifically, the intermittent actuating means produces the pump signal with a selectable first duration and with a selectable first periodicity. Alternately, the intermittent actuating means may produce the pump signal for the first duration in response to a sensed condition, such as water opacity or cloudiness, fluid temperature, fluid receiving apparatus temperature, and the like. In the preferred embodiment, the intermittent actuating means includes a manually adjustable first or cyclic actuating means timer 32 which closes a cycle switch 34. The cycle switch 34 provides the pump signal between power supply lines 36 and 38 to a pump motor 40 for driving the circulating pump B. In the preferred embodiment, the first timer comprises a twenty-four (24) hour timer which closes the cycle switch 34 a manually settable number of times a day for a manually settable preselected duration, e.g. 30 minutes.

A low or abnormal pressure shutdown means 50 terminates operation of the circulating pump unless a circulation fluid pressure monitored by pressure monitor 20 attains a preselected pressure level within a preselected time period. More specifically, the abnormal pressure shutdown means includes a time controlled switching means 52 for conducting the pump signal to the pump for the preselected time period. The preselected time period is timed by a second timer 54 which is operatively connected with the intermittent actuating means 30. The second timer 54 is connected with the cycle switch 34 for actuation by the pump signal to start timing the preselected time period. At the expiration of the preselected time period, the second timer 54 closes a switch 56 which supplies power through the cycle switch 34 to a control coil 58. The coil 58 controls switch contacts 60 of the time controlled switching means to terminate passage of the pump signal after the preselected time period. In the preferred embodiment, the preselected time period is two (2) minutes. However, it will be appreciated that this time period necessarily may be varied to accommodate different operating parameters or conditions.

The abnormal pressure shutdown means 50 further includes a pressure controlled low pressure switch 62 which bypasses the time controlled switching means 52. The low pressure switch is closed in response to a first or preselected minimum operating pressure being sensed by the pressure sensing means 20. In the preferred embodiment, the preselected operating pressure is approximately 5 psi. It is to be appreciated that this pressure, as well as other pressures noted hereinafter, merely comprise preferred pressures. Thus, alterations may be made thereto without in any way departing from the invention. A bypass switch 64 which is connected in series with a time controlled switching means 52 is likewise bypassed by the low pressure switch 62. The bypass switch comprises a normally closed switch which is opened in response to the pressure sensing means 20 sensing a second preselected pressure. In the preferred embodiment, the second preselected pressure is also approximately 5 psi. More specifically, however, the second preselected pressure is slightly higher than the first preselected operating pressure such that the pressure controlled low pressure switch closes before the bypass switch opens.

The pressure shutdown means 50 further includes a high pressure shutoff switch 66 which is connected in series with the intermittent actuating means 30 and the pump motor 40. The high pressure shutoff switch terminates receipt of the pump signal by the pump motor in response to the pressure sensing means 20 sensing a preselected high pressure. In the preferred embodiment, the preselected high pressure is about 10 psi.

A manual reset means or switch 68 is connected with the second timer 54 to cause timing of the preselected time period to be recommenced. In this manner, if the pump fails to attain the 5 psi pressure in the preselected time period, the pump can be manually caused to try once more to attain the 5 psi pressure.

A mode selection switch 70 has three positions—automatic, manual, and off. In the "automatic" position, the mode selection switch connects the pump motor in series with the intermittent actuating means 30 and the abnormal pressure shutdown means 50. In the "manual" position, the mode selection switch connects the pump motor directly between the power supply lines 36 and 38 to thus cause the motor to run continuously for an indefinite period. In the "off" position, the mode control switch prevents the pump motor from receiving power, while maintaining integrity of the 24-hour timer 30.

In the preferred embodiment, the mode control switch is connected with a power relay 72 which closes normally open contacts 74 in response to the pump signal. The use of a power relay advantageously permits the pump motor to draw more power than is passed through the other components of the control circuit. This reduces arcing across contacts of the control circuit switches. The power relay is also advantageous when the pump motor is a three phase type motor. Taken together, the power relay and pump motor comprise a pump motor means.

In operation, the intermittent actuating means is manually set for the times of day at which the water is to be filtered and the duration for which it is to be filtered. When the first timer 32 reaches the selected time of day, the cycle switch 34 is closed for the preselected duration. The pump signal is conveyed from power line 36 through the cycle switch 34 to the second timing means 54 and to the pump motor 40. More specifically, the pump signal is conveyed to the pump motor 40 through the bypass switch 64, the time controlled switching means 52, the high pressure shutoff switch 66, the mode selection switch 70, and the power relay 72, 74.

After the preselected time period, the second timer 54 closes the switch 56 which, in turn, opens the contacts 60 of the time controlled switch 52. If the pressure sensed by pressure monitor 20 has not yet reached the first preselected pressure, the pump motor shuts off. The pump then remains off until the next cycle of the first timer 32 unless the manual reset button 68 is depressed.

If, during the preselected time period, the sensed pressure exceeds the first preselected pressure, the pressure controlled low pressure switch 62 closes. Closing the low pressure switch provides a path around the time controlled switch 52. The low pressure switch enables the pump motor to continue to operate until the first timer 32 opens the cycle switch 34, or until the low pressure switch 62 opens in response to a low pressure condition.

If an excessively high pressure condition occurs, the high pressure shutoff switch 66 opens for blocking the pump signal from reaching the pump motor. If the sensed pressure drops sufficiently, the high pressure shutoff switch 66 remains open until manually reset by, for example, a switch 76, unless the first timer 32 has timed out.

The invention has been described with reference to the preferred embodiment. Obviously, modifications and alterations will occur to others upon reading and understanding the preceding detailed description of the preferred embodiment. It is intended that the invention be construed as including all such modifications and alterations insofar as they come within the scope of the appended claims or the equivalents thereof.

Having thus described the invention, it is now claimed:

1. A control circuit for controlling cyclic operation of a circulation pump, the control circuit comprising:

an intermittent actuating means for intermittently producing a pump signal, the intermittent actuating means being operatively connected with the circulation pump for pumping a circulation fluid through a fluid receiving apparatus, the intermittent actuating means including a first timer for producing the pump signal at selected, regular intervals;

a pressure monitor for monitoring the pressure of the circulating fluid; and, a low pressure shutdown means for terminating operation of the circulating pump unless the monitored circulation fluid pressure attains a first preselected pressure within a preselected time period, the low pressure shutdown means includes, A. a second timer which is operatively connected with the first timer to be actuated by the pump signal to commence timing said preselected time period, the second timer causing a time controlled switching means to conduct the pump signal for the preselected time period; and, B. a pressure controlled low pressure switch which passes the pump signal around the time controlled switching means in response to the monitored circulation fluid pressure exceeding the first preselected pressure such that the circulation pump continues to be activated by the pump signal; and, C. a bypass switch connected electrically in series with the time controlled switching means, the pressure controlled low pressure switch bypassing the bypass switch and the time controlled switching means, the bypass switch conducting the pump signal in response to sensing a pressure below a second preselected pressure, the second preselected pressure meeting or exceeding the first preselected pressure such that the pressure controlled low pressure switch closes as or before the bypass switch opens.

2. The control circuit as set forth in claim 1 further including a high pressure shutoff means for terminating actuation of the circulation pump in response to the monitored pressure attaining a third preselected pressure, the third preselected pressure exceeding the second preselected pressure.

3. The control circuit as set forth in claim 2 further including a power relay which receives the pump signal and is actuated thereby to provide electric power to an electric motor which is operatively connected to the circulation pump.

4. The control circuit as set forth in claim 3 further including a manual pump actuation switch which is manually controllable to actuate the power relay, whereby the circulation pump is manually actuatable.

5. The control circuit as set forth in claim 4 wherein the circulation pump circulates water from a swimming pool, through a water filter, and back to the swimming pool.

* * * * *